US010345733B2

(12) United States Patent
Kusukawa

(10) Patent No.: US 10,345,733 B2
(45) Date of Patent: Jul. 9, 2019

(54) IMAGE FORMING APPARATUS AND DEVELOPMENT UNIT

(71) Applicant: KYOCERA Document Solutions Inc., Osaka (JP)

(72) Inventor: Takashi Kusukawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/916,325

(22) Filed: Mar. 9, 2018

(65) Prior Publication Data

US 2018/0267426 A1 Sep. 20, 2018

(30) Foreign Application Priority Data

Mar. 15, 2017 (JP) ..... 2017-049866

(51) Int. Cl.
*G03G 15/08* (2006.01)
*G03G 15/16* (2006.01)
*G03G 21/16* (2006.01)

(52) U.S. Cl.
CPC ..... *G03G 15/0808* (2013.01); *G03G 15/0806* (2013.01); *G03G 21/1671* (2013.01); *G03G 21/1676* (2013.01); *G03G 15/1605* (2013.01); *G03G 2221/1654* (2013.01)

(58) Field of Classification Search
CPC ..... G03G 2215/0872
See application file for complete search history.

(56) References Cited

U.S. PATENT DOCUMENTS

2009/0110434 A1* 4/2009 Kusudo ..... G03G 15/0813 399/109
2010/0054823 A1* 3/2010 Takasaka ..... F16D 1/10 399/286
2012/0051798 A1* 3/2012 Kunihiro ..... G03G 15/0812 399/274
2014/0112679 A1* 4/2014 Choi ..... G03G 21/1652 399/90
2015/0268582 A1* 9/2015 Funada ..... G03G 15/0881 399/258

FOREIGN PATENT DOCUMENTS

JP H02-093550 A 4/1990

* cited by examiner

*Primary Examiner* — Victor Verbitsky
(74) *Attorney, Agent, or Firm* — Studebaker & Brackett PC

(57) ABSTRACT

An image forming apparatus includes an image carrier, a development unit, and an apparatus main body. On the image carrier, an electrostatic latent image is formed. The development unit develops the electrostatic latent image formed on the image carrier. To the apparatus main body, the development unit is attached. The development unit includes a toner supplying member, a supporting member, at least one mounting component, and at least one pressing member. The toner supplying member supplies a toner to the image carrier. The supporting member supports the toner supplying member. The at least one mounting component is positioned to the apparatus main body and rotatably supports the supporting member. The at least one pressing member presses the toner supplying member to the image carrier by biasing the supporting member in a rotating direction.

4 Claims, 9 Drawing Sheets

IMAGE FORMING APPARATUS AND DEVELOPMENT UNIT

INCORPORATION BY REFERENCE

This application is based on and claims the benefit of priority from Japanese patent application No. 2017-049866 filed on Mar. 15, 2017, which is incorporated by reference in its entirety.

BACKGROUND

The present disclosure relates to an image forming apparatus and a development unit provided in the image forming apparatus.

An electrographic image forming apparatus conventionally includes a development unit that develops an electrostatic latent image formed on an image carrier (e.g., a photosensitive drum). For example, a developing method used in the development unit is proposed as follows: A developer layer is formed on a toner supplying member (e.g., a magnetic roller) provided in the development unit, and the developer layer is brought into contact with the image carrier, thereby causing a toner to be adhered to the electrostatic latent image on the image carrier.

SUMMARY

In accordance with an aspect of the present disclosure, an image forming apparatus includes an image carrier, a development unit, and an apparatus main body. On the image carrier, an electrostatic latent image is formed. The development unit develops the electrostatic latent image formed on the image carrier. To the apparatus main body, the development unit is attached. The development unit includes a toner supplying member, a supporting member, at least one mounting component, and at least one pressing member. The toner supplying member supplies a toner to the image carrier. The supporting member supports the toner supplying member. The at least one mounting component is positioned to the apparatus main body and rotatably supports the supporting member. The at least one pressing member presses the toner supplying member to the image carrier by biasing the supporting member in a rotating direction.

In accordance with an aspect of the present disclosure, a development unit is attached to an apparatus main body of an image forming apparatus to develop an electrostatic latent image formed on an image carrier. The development unit includes a toner supplying member, a supporting member, at least one mounting component, and at least one pressing member. The toner supplying member supplies a toner to the image carrier. The supporting member supports the toner supplying member. The at least one mounting component is positioned to the apparatus main body and rotatably supports the supporting member. The at least one pressing member presses the toner supplying member to the image carrier by biasing the supporting member in a rotating direction.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the drawings, an image forming apparatus 1 according to one embodiment of the present disclosure will be described. Arrows Fr, Rr, L, R, U and Lo shown in each figure respectively indicate a front side, a rear side, a left side, a right side, an upper side and a lower side of the image forming apparatus 1.

Firstly, an entire structure of the image forming apparatus 1 will be described. For example, the image forming apparatus 1 is a multifunctional peripheral which has multiple functions like a print function, a copy function, and a facsimile function.

Figure 1:
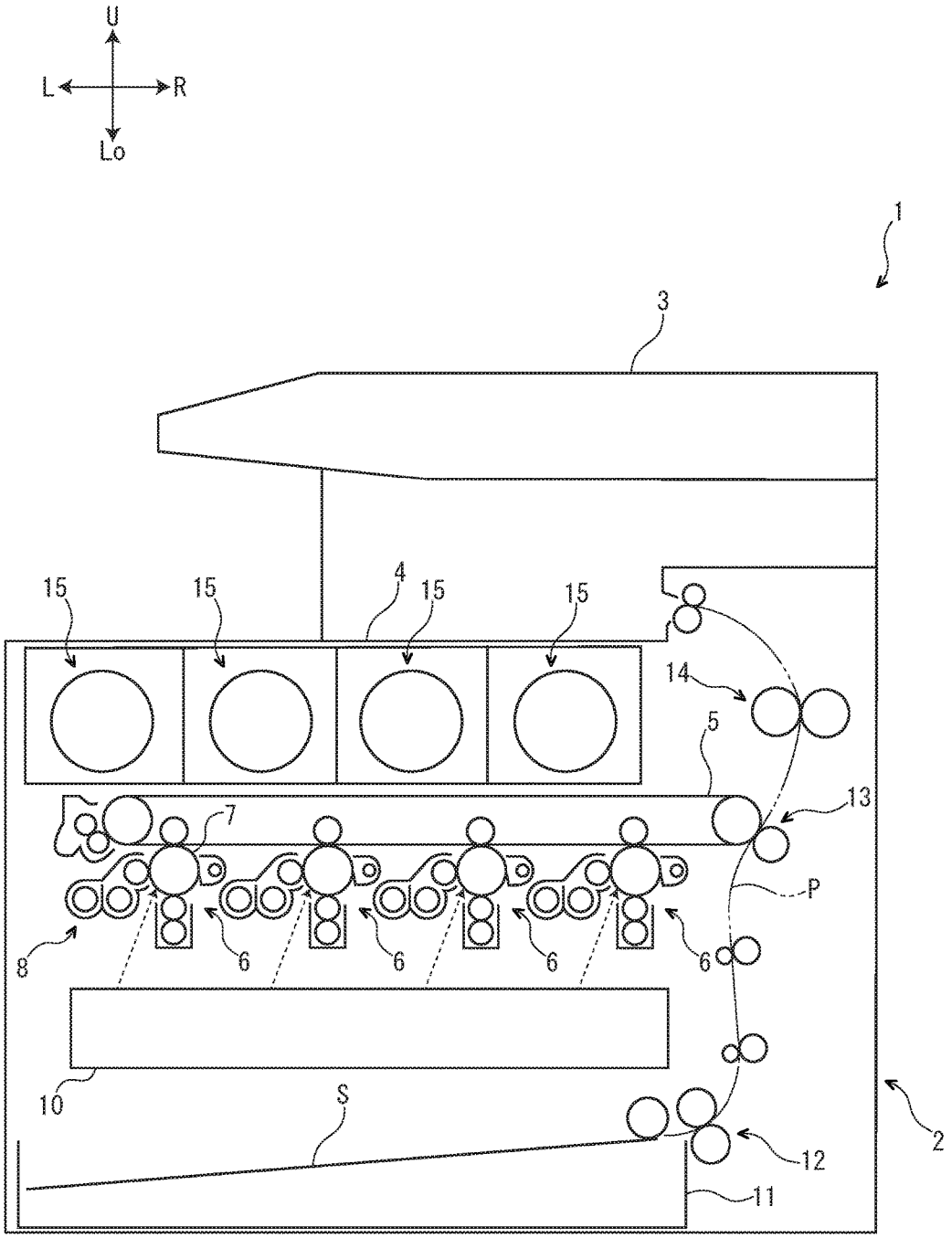
FIG. 1 is a schematic view illustrating an image forming apparatus according to one embodiment of the present disclosure.

With reference to FIG. 1, the image forming apparatus 1 includes a box-shaped apparatus main body 2. In an upper end portion of the apparatus main body 2, an image reading device 3 to read an original image is provided.

In an upper portion of the apparatus main body 2, an ejected sheet tray 4 is provided. In an approximate center portion of the apparatus main body 2, an intermediate transferring belt 5 and four image forming parts 6 are housed. Each image forming part 6 corresponds to, for example, each toner of black, cyan, magenta and yellow. Each image forming part 6 includes a photosensitive drum 7 (an example of an image carrier) and a development unit 8. In a lower portion of the apparatus main body 2, an exposing device 10 is housed. In a lower end portion of the apparatus main body 2, a sheet feeding cassette 11 storing a sheet S (an example of a recording medium) is housed.

In a right side portion of the apparatus main body 2, a conveying path P for the sheet S is provided. At an upstream end portion of the conveying path P, a sheet feeding part 12 is provided. At a middle portion of the conveying path P, a secondary transferring part 13 is provided. At a downstream portion of the conveying path P, a fixing device 14 is provided.

In the upper portion of the apparatus main body 2, four toner containers 15 (an example of a toner case) are stored below the ejected sheet tray 4. Each toner container 15 corresponds to, for example, each toner of black, cyan, magenta and yellow.

Next, an operation of the image forming apparatus 1 will be described.

Firstly, light (refer to a dot line arrow in FIG. 1) emitted from the exposing device 10 forms an electrostatic latent image on the photosensitive drum 7 of each image forming part 6. The electrostatic latent image is developed by the development unit 8 of each image forming part 6. Thereby, a toner image is carried on the photosensitive drum 7 of each image forming part 6. The toner image is primarily transferred from the photosensitive drum 7 of each image forming part 6 to the intermediate transferring belt 5. Thereby, a full color toner image is formed on the intermediate transferring belt 5.

On the other hand, the sheet S fed from the sheet feeding cassette 11 by the sheet feeding part 12 is conveyed to a downstream side along the conveying path P and enters the secondary transferring part 13. At the secondary transferring part 13, the full color toner image formed on the intermediate transferring belt 5 is secondarily transferred to the sheet S. The sheet S on which the toner image is secondarily transferred is further conveyed to the downstream side along the conveying path P and enters the fixing device 14. The fixing device 14 fixes the toner image on the sheet S. The sheet S on which the toner image is fixed is ejected on the ejected sheet tray 4.

Next, the apparatus main body 2 will be further described.

Figure 2:
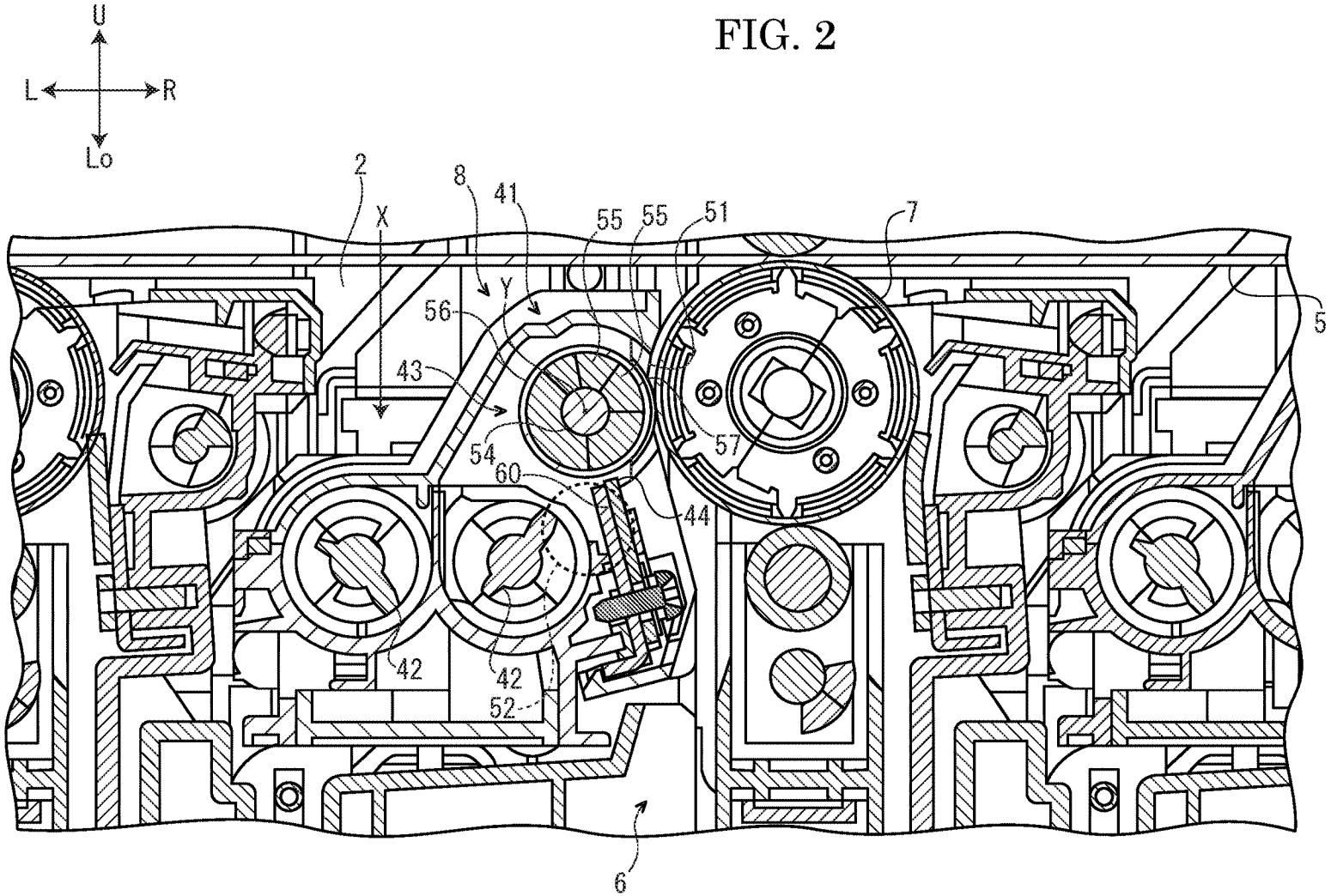
FIG. 2 is a sectional view illustrating an image forming part and its periphery according to the one embodiment of the present disclosure.
Figure 3:
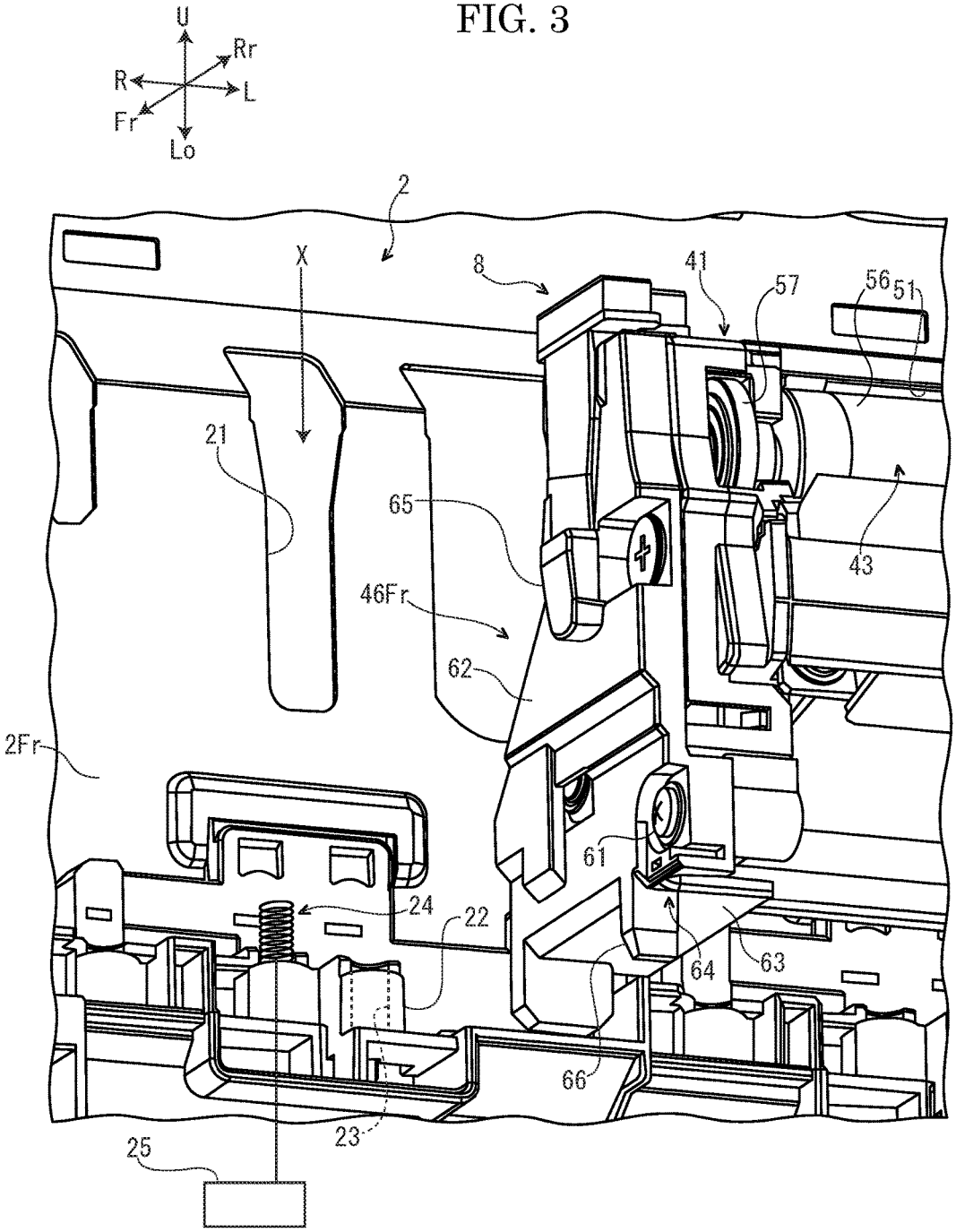
FIG. 3 is a perspective view illustrating a front part of an apparatus main body and a front part of a development unit according to the one embodiment of the present disclosure.
Figure 4:
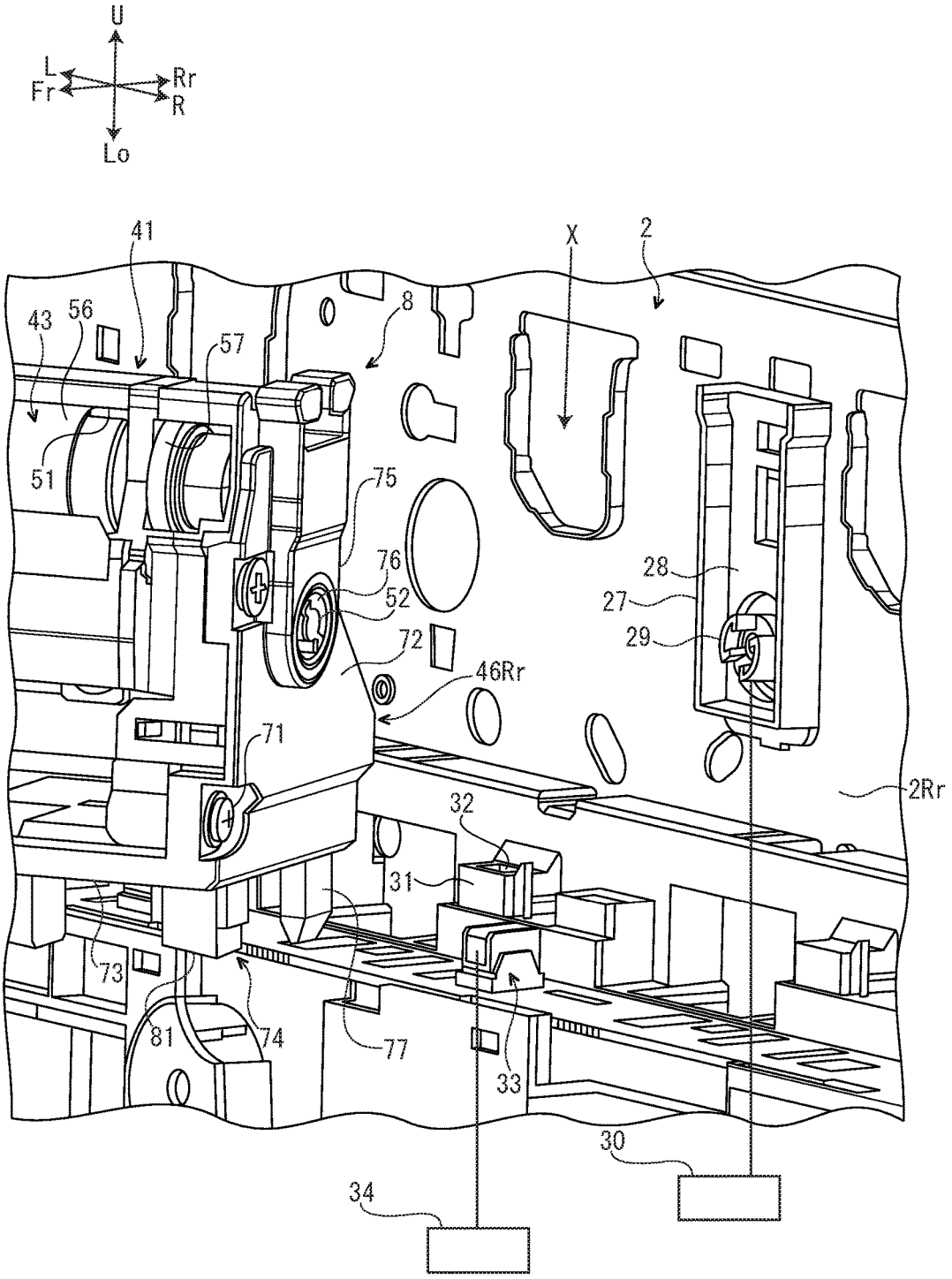
FIG. 4 is a perspective view illustrating a rear part of the apparatus main body and a rear part of the development unit according to the one embodiment of the present disclosure.

With reference to FIG. 2, the development unit 8 of each image forming part 6 (hereinafter, simply referred to as "the development unit 8") is detachably attached to the apparatus main body 2 along an attachment direction X. In FIGS. 3 and 4, the development unit 8 is illustrated in a direction different from an actual direction, in order to intelligibly show an engaging section between the apparatus main body 2 and the development unit 8.

With reference to FIG. 3, the apparatus main body 2 includes a front end wall 2Fr to cover the front side of the development unit 8. A front side first recess 21 is provided at a position corresponding to the development unit 8 in the upper part of the rear face (inner face) of the front end wall 2Fr. The front side first recess 21 extends along the attachment direction X and is opened to the upper side (upstream side in the attachment direction X) and the rear side.

A front side cylinder 22 is provided at a position corresponding to the development unit 8 in the lower part of the rear face of the front end wall 2Fr of the apparatus main body 2. A front side second recess 23 is provided inside the front side cylinder 22. The front side second recess 23 extends along the attachment direction X and is opened to the upper side (upstream side in the attachment direction X). The front side second recess 23 is arranged on the lower side (downstream side in the attachment direction X) with respect to the front side first recess 21. A main body side high voltage contact 24 is provided at a position corresponding to the development unit 8 in the lower part of the rear face of the front end wall 2Fr. The main body side high voltage contact 24 is connected to a high voltage substrate 25.

With reference to FIG. 4, the apparatus main body 2 includes a rear end wall 2Rr to cover the rear side of the development unit 8. A frame 27 is provided at a position corresponding to the development unit 8 in the upper part of the front face (inner face) of the rear end wall 2Rr. A rear side first recess 28 is provided inside the frame 27. The rear side first recess 28 extends along the attachment direction X and is opened to the upper side (upstream side in the attachment direction X) and the front side. A main body side joint 29 is stored in the lower part of the rear side first recess 28. The main body side joint 29 is rotatably provided and connected to a driving source 30 constituted by a motor.

A rear side cylinder 31 is provided at a position corresponding to the development unit 8 in the lower part of the front face of the rear end wall 2Rr of the apparatus main body 2. A rear side second recess 32 is provided inside the rear side cylinder 31. The rear side second recess 32 extends along the attachment direction X and is opened to the upper side (upstream side in the attachment direction X). The rear side second recess 32 is arranged on the lower side (downstream side in the attachment direction X) with respect to the rear side first recess 28. A main body side connector 33 is provided in the lower part of the front face of the rear end wall 2Rr. The main body side connector 33 is connected to a controller 34.

Next, the development unit 8 will be further described.

Figure 5:
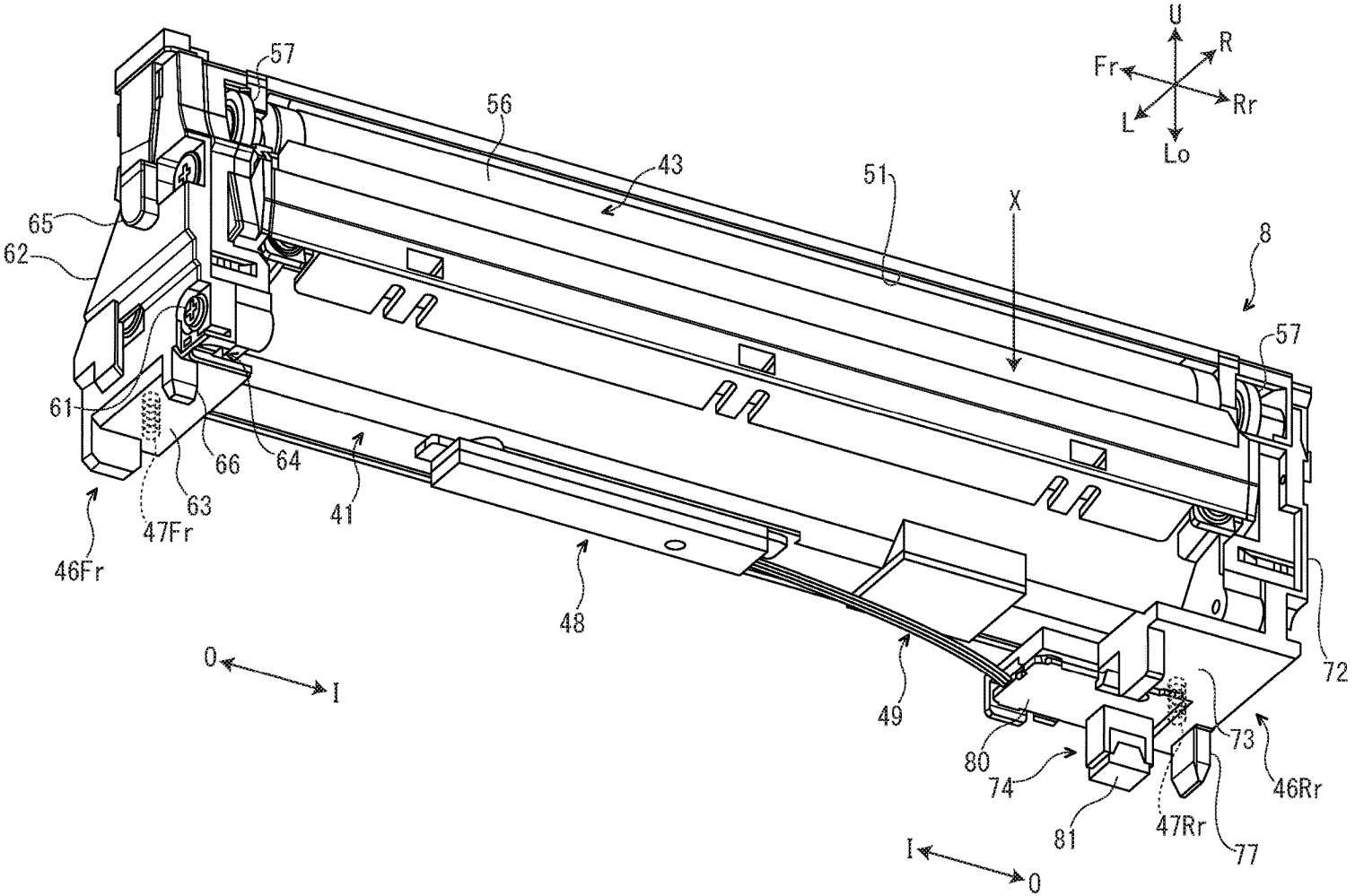
FIG. 5 is a perspective view illustrating the development unit according to the one embodiment of the present disclosure.

An arrow O appropriately illustrated in each figure on and after FIG. 5 indicates an outside in the front-and-rear direction of the development unit 8, and an arrow I appropriately illustrated in each figure on and after FIG. 5 indicates an inside in the front-and-rear direction of the development unit 8.

With reference to FIGS. 2 and 5, the development unit 8 includes a supporting member 41, a pair of left and right agitating screws 42 stored in the lower part of the supporting member 41, a magnetic roller 43 (one example of a toner supplying member) stored in the upper part of the supporting member 41, a blade 44 provided below the magnetic roller 43, a front side mounting component 46Fr provided on the front side (outside in the front-and-rear direction) of the supporting member 41, a rear side mounting component 46Rr provided on the rear side (outside in the front-and-rear direction) of the supporting member 41, a front side coil spring 47Fr (one example of a pressing member) provided on the lower left side of the front side mounting component 46Fr, a rear side coil spring 47Rr (one example of a pressing member) provided on the lower left side of the rear side mounting component 46Rr, a sensor 48 (one example of an electrical component) provided on the lower side of the supporting member 41, and a wire 49 provided on the lower rear side of the sensor 48. As described above, the development unit 8 includes the pair of mounting components 46Fr and 46Rr and the pair of coil springs 47Fr and 47Rr.

The supporting member 41 of the development unit 8 has a box shape elongated in the front-and-rear direction. Developer is stored in the internal space of the supporting member 41. For example, the developer is two-component developer composed of a nonmagnetic toner and a magnetic carrier. An opening 51 is provided on the right face of the supporting member 41. A developer replenishment port (not illustrated) is provided in the supporting member 41, and the developer is configured to be replenished the internal space of the supporting member 41 from each toner container 15 (see FIG. 1) through the developer replenishment port. With reference to FIG. 4, a unit side joint 52 is rotatably provided on the rear face (face on the outside in the front-and-rear direction) of the supporting member 41.

With reference to FIG. 2, the pair of left and right agitating screws 42 of the development unit 8 is arranged in the internal space of the supporting member 41. Each agitating screw 42 has a shape elongated in the front-and-rear direction. Each agitating screw 42 is rotatably supported by the supporting member 41. Each agitating screw 42 is connected to the unit side joint 52 via a connection mechanism (not illustrated).

With reference to FIGS. 2 and 5, the magnetic roller 43 of the development unit 8 has a shape elongated in the front-and-rear direction. The magnetic roller 43 includes a roller shaft 54, plural magnetic poles 55 to cover the outer circumference of the roller shaft 54, a sleeve 56 to cover the outer circumference of the plural magnetic poles 55, and a pair of rollers 57 arranged on the front side and the rear side (both outsides in the front-and-rear direction) of the sleeve 56.

The roller shaft 54 of the magnetic roller 43 extends along the front-and-rear direction. The roller shaft 54 is supported by the supporting member 41 in a state where the roller shaft 54 is not rotatable.

Each magnetic pole 55 of the magnetic roller 43 has a fan-shaped cross section. Each magnetic pole 55 is fixed to the roller shaft 54 of the magnetic roller 43 and is supported by the supporting member 41 via the roller shaft 54 in a state where each magnetic pole 55 is not rotatable.

The sleeve 56 of the magnetic roller 43 is formed of a nonmagnetic material and has a cylindrical shape. The sleeve 56 is rotatably supported by the supporting member 41 and rotatably provided around a rotation axis Y extended along the front-and-rear direction (one example of one direction). That is, in the present embodiment, the front-and-rear direction is the rotation axis direction of the sleeve 56. The sleeve 56 is exposed to the outside of the development unit 8 via the opening 51 of the supporting member 41 and faces to a sheet passing region (region through which a sheet passes) of the photosensitive drum 7 with an interval. The sleeve 56 is connected to the unit side joint 52 via a connection mechanism (not illustrated).

Each roller 57 of the magnetic roller 43 is arranged coaxially with the sleeve 56 of the magnetic roller 43. The outer diameter of each roller 57 is larger than the outer diameter of the sleeve 56. Each roller 57 is rotatably supported by the roller shaft 54 of the magnetic roller 43 or rotatably supported by another roller shaft (not illustrated) independent of the roller shaft 54 of the magnetic roller 43. Each roller 57 is exposed to the outside of the supporting member 41 and comes in contact with a non-sheet passing region (region through which a sheet does not pass) of the photosensitive drum 7. This allows the each roller 57 to regulate an interval between the sleeve 56 and the sheet passing region of the photosensitive drum 7.

The blade 44 of the development unit 8 is fixed to the supporting member 41. The upper end part (tip end part) of the blade 44 faces the outer circumference of the sleeve 56 of the magnetic roller 43 with an interval.

Figure 6:
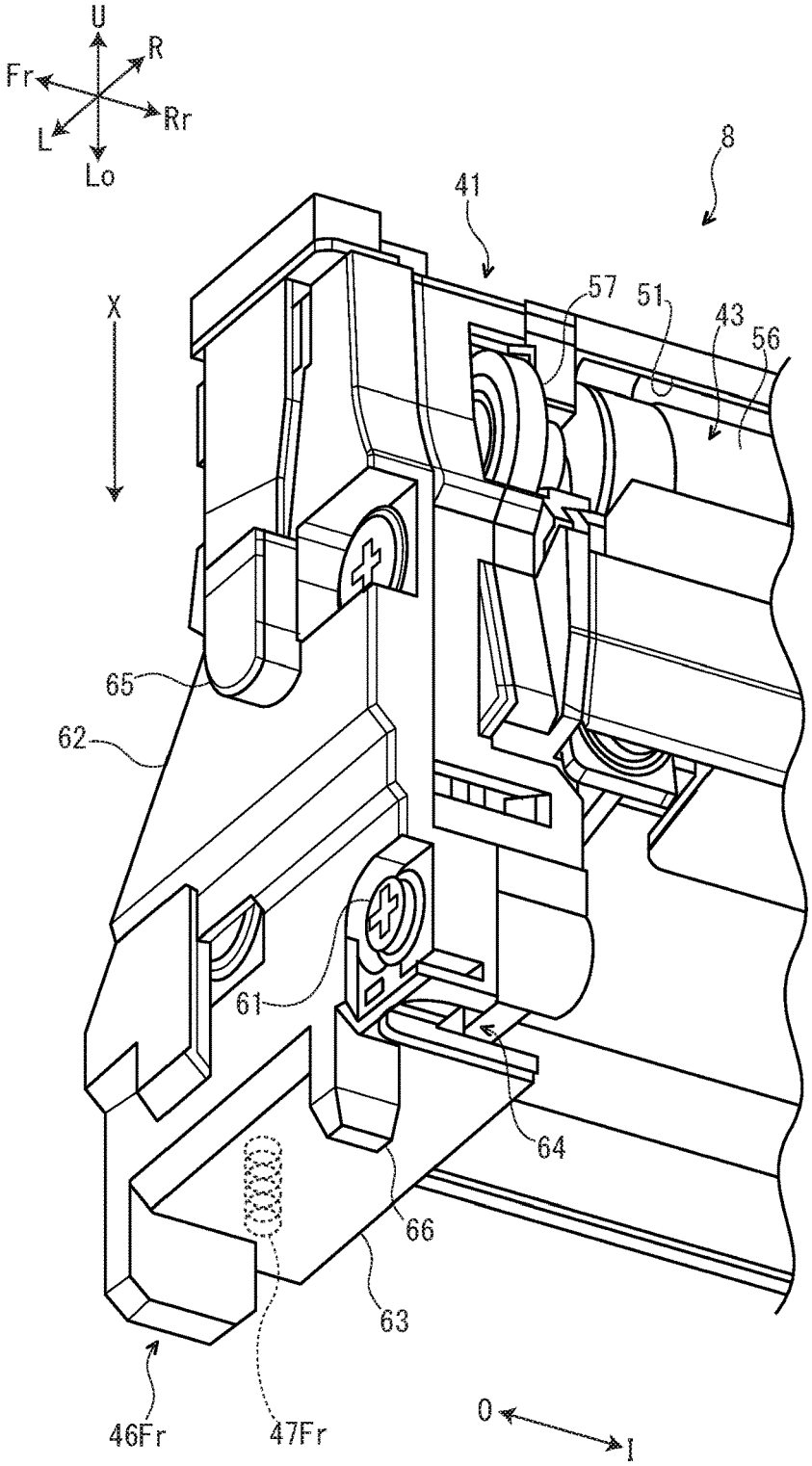
FIG. 6 is a perspective view illustrating the front part of the development unit according to the one embodiment of the present disclosure.

With reference to FIG. 6, the lower right part of the front side mounting component 46Fr of the development unit 8 is attached to the front end part (one end part in the front-and-rear direction) of the supporting member 41 via a front side pivot 61. This allows the front side mounting component 46Fr to support the front end part of the supporting member 41 so that the supporting member 41 is rotatable on the front side pivot 61.

The front side mounting component 46Fr includes a front side base plate 62 extended along the up-and-down direction, a front side protruding plate 63 that protrudes from the lower end part of the front side base plate 62 to the rear side (inside in the front-and-rear direction), and a unit side high voltage contact 64 provided on the lower right side of the front side base plate 62.

A front side first protrusion 65 is provided in the upper part of the front face of the front side base plate 62 of the front side mounting component 46Fr. The front side first protrusion 65 extends along the attachment direction X. A front side second protrusion 66 is provided on the bottom face of the front side base plate 62. The front side second protrusion 66 extends along the attachment direction X. The front side second protrusion 66 is arranged on the lower side (downstream side in the attachment direction X) with respect to the front side first protrusion 65.

Figure 7:
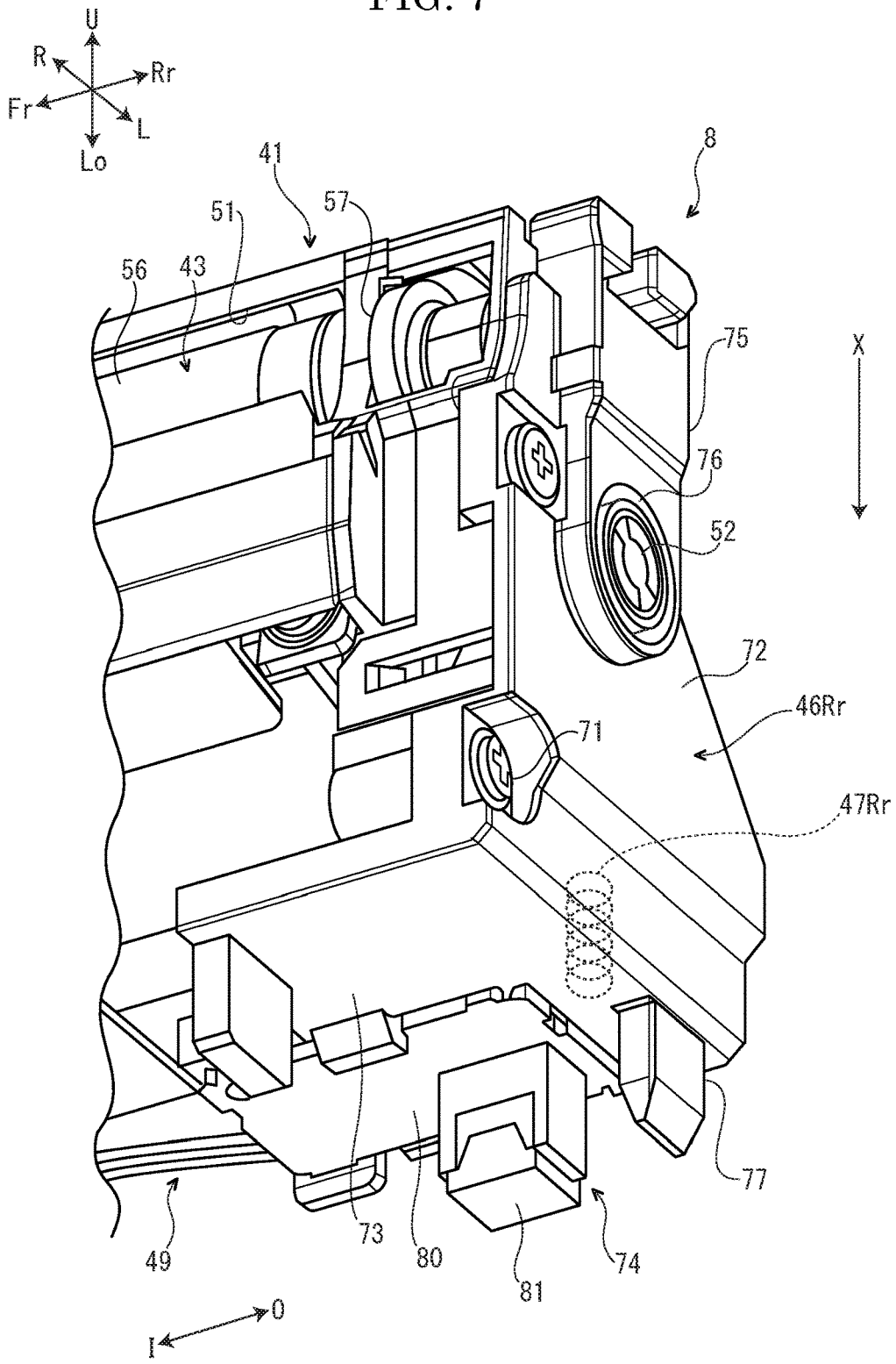
FIG. 7 is a perspective view illustrating the rear part of the development unit according to the one embodiment of the present disclosure.

With reference to FIG. 7, the lower right part of the rear side mounting component 46Rr of the development unit 8 is attached to the rear end part (the other end part in the front-and-rear direction) of the supporting member 41 via a rear side pivot 71. This allows the rear side mounting component 46Rr to support the rear end part of the supporting member 41 so that the supporting member 41 is rotatable on the rear side pivot 71.

The rear side mounting component 46Rr includes a rear side base plate 72 extended along the up-and-down direction, a rear side protruding plate 73 that protrudes from the lower end part of the rear side base plate 72 to the front side (inside in the front-and-rear direction), and a unit side connector 74 provided on the lower side of the rear side protruding plate 73.

A rear side first protrusion 75 is provided in the upper part of the rear face of the rear side base plate 72 of the rear side mounting component 46Rr. The rear side first protrusion 75 extends along the attachment direction X. A through hole 76 is provided in the lower part of the rear side first protrusion 75, and the unit side joint 52 of the supporting member 41 is exposed to the outside of the development unit 8 through the through hole 76. A rear side second protrusion 77 is provided on the bottom face of the rear side base plate 72. The rear side second protrusion 77 extends along the attachment direction X. The rear side second protrusion 77 is arranged on the lower side (downstream side in the attachment direction X) with respect to the rear side first protrusion 75.

The unit side connector 74 of the rear side mounting component 46Rr includes a substrate 80 attached to the bottom face of the rear side protruding plate 73 of the rear side mounting component 46Rr and a connector main body 81 that protrudes downward from the substrate 80.

Figure 8:
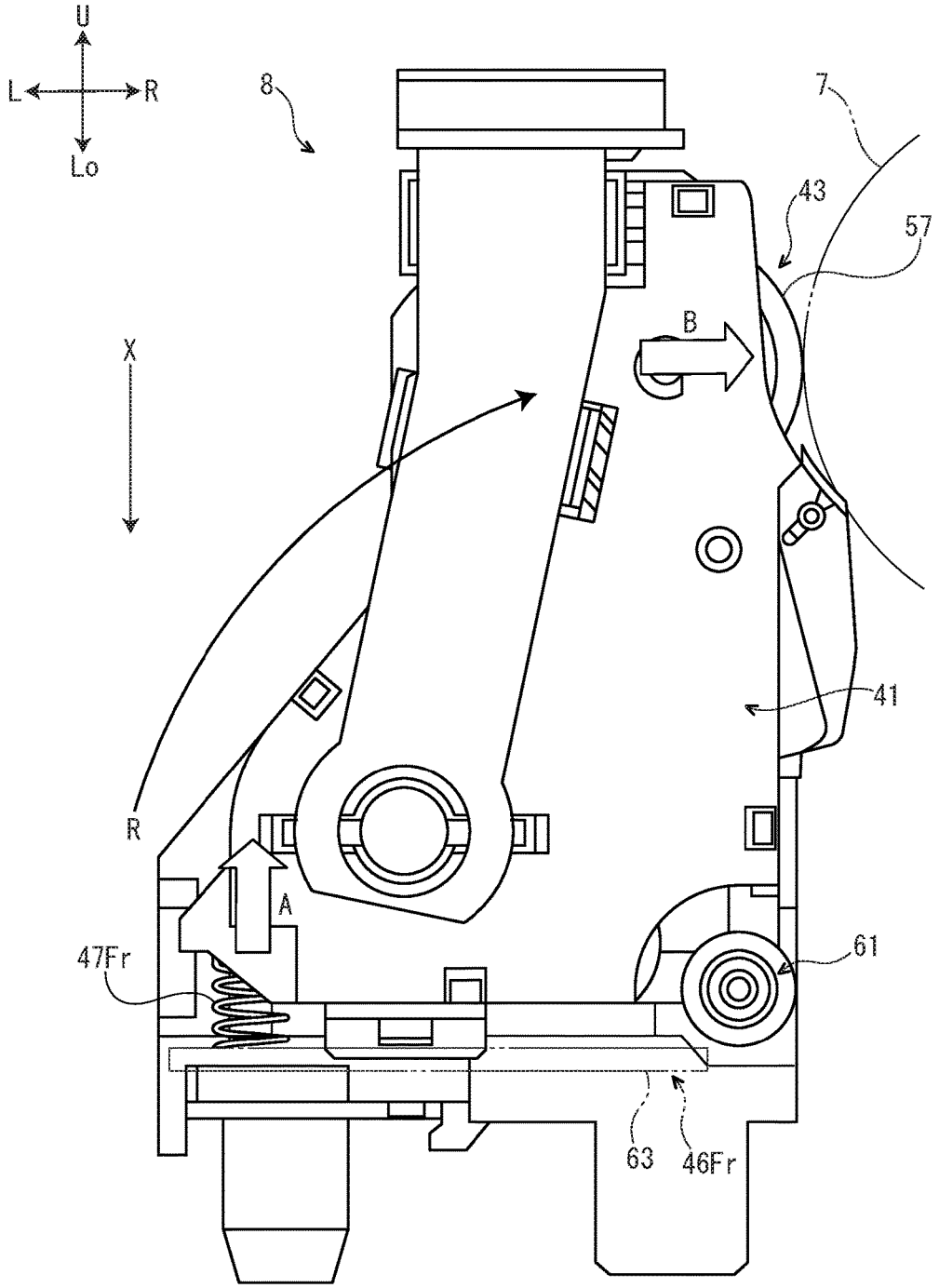
FIG. 8 is a front view illustrating the development unit according to the one embodiment of the present disclosure.

With reference to FIG. 8, the front side coil spring 47Fr of the development unit 8 is arranged between the bottom face of the supporting member 41 and the upper face of the front side protruding plate 63 of the front side mounting component 46Fr (only the front side protruding plate 63 is illustrated by a chain double-dashed line in FIG. 8). As illustrated by an arrow A in FIG. 8, the front side coil spring 47Fr presses the supporting member 41 to the upper side, thereby biasing the supporting member 41 in a rotating direction R. Thus, as illustrated by an arrow B in FIG. 8, the front side coil spring 47Fr presses the magnetic roller 43 to the photosensitive drum 7, and the roller 57 on the front side of the magnetic roller is pressed to the non-sheet passing region of the photosensitive drum 7.

Figure 9:
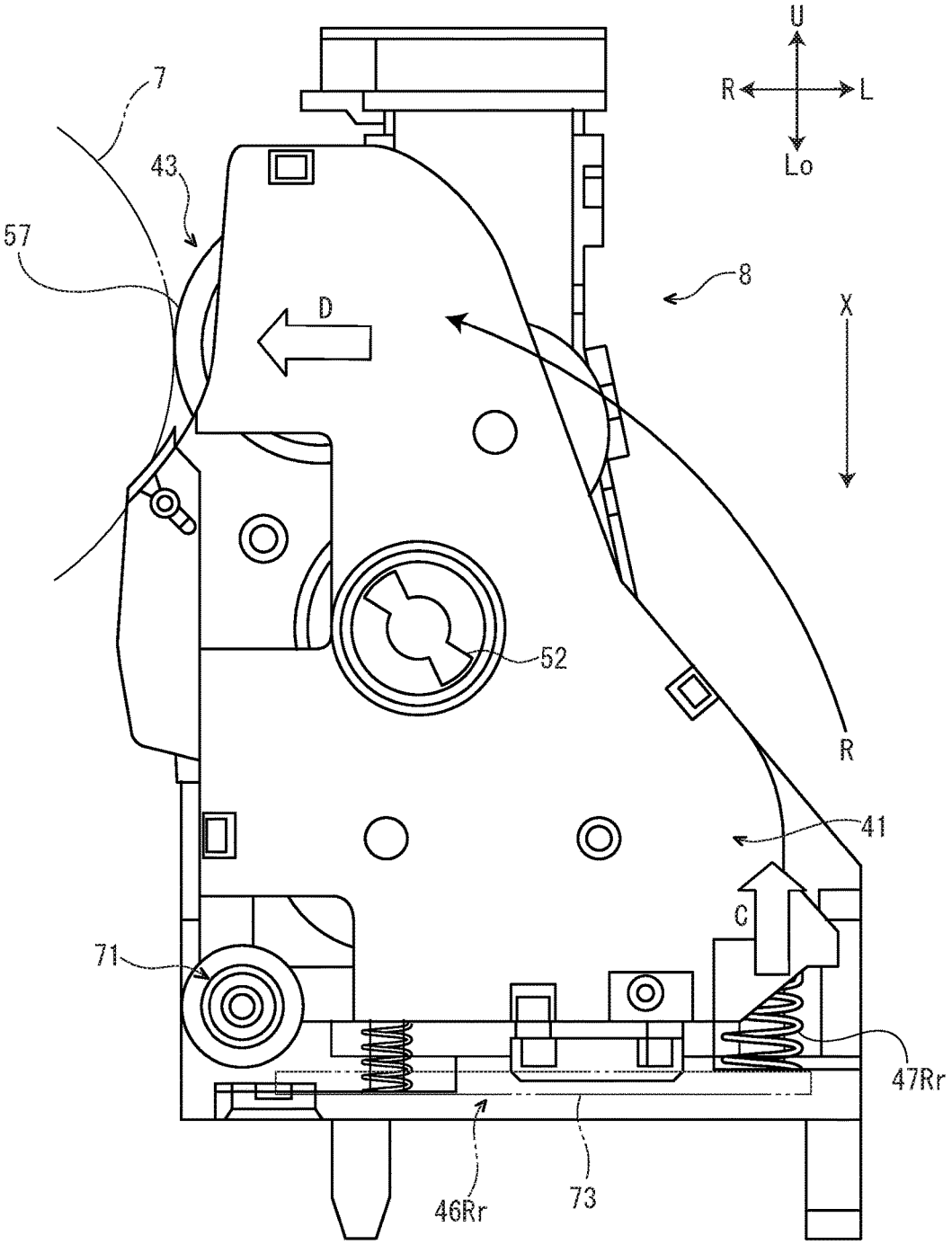
FIG. 9 is a rear view illustrating the development unit according to the one embodiment of the present disclosure.

With reference to FIG. 9, the rear side coil spring 47Rr of the development unit 8 is arranged between the bottom face of the supporting member 41 and the upper face of the rear side protruding plate 73 of the rear side mounting component 46Rr (only the rear side protruding plate 73 is illustrated by a chain double-dashed line in FIG. 9). As illustrated by an arrow C in FIG. 9, the rear side coil spring 47Rr presses the supporting member 41 to the upper side, thereby biasing the supporting member 41 in the rotating direction R. Thus, as illustrated by an arrow D in FIG. 9, the rear side coil spring 47Rr presses the magnetic roller 43 to the photosensitive drum 7, and the roller 57 on the rear side of the magnetic roller is pressed to the non-sheet passing region of the photosensitive drum 7.

With reference to FIG. 5, the sensor 48 of the development unit 8 is attached to the bottom face of the supporting member 41. For example, the sensor 48 is a magnetic permeability sensor to detect the toner density of the developer in the supporting member 41.

The wire 49 of the development unit 8 connects the sensor 48 to the substrate 80 of the unit side connector 74 of the rear side mounting component 46Rr. The wire 49 is slightly bent.

In the image forming apparatus 1 with the aforementioned configuration, when the development unit 8 is attached to the apparatus main body 2, an operator such as a user or a service engineer inserts the development unit 8 into the apparatus main body 2 along the attachment direction X.

With reference to FIG. 3, as the development unit 8 is attached to the apparatus main body 2, the front side first protrusion 65 of the front side mounting component 46Fr is engaged with the front side first recess 21 of the apparatus main body 2, and the front side second protrusion 66 of the front side mounting component 46Fr is engaged with the front side second recess 23 of the apparatus main body 2. With reference to FIG. 4, as the development unit 8 is attached to the apparatus main body 2, the rear side first protrusion 75 of the rear side mounting component 46Rr is engaged with the rear side first recess 28 of the apparatus main body 2, and the rear side second protrusion 77 of the rear side mounting component 46Rr is engaged with the rear side second recess 32 of the apparatus main body 2. Consequently, the mounting components 46Fr and 46Rr are positioned to the apparatus main body 2.

With reference to FIG. 3, as the development unit 8 is attached to the apparatus main body 2, the unit side high voltage contact 64 of the front side mounting component 46Fr comes in contact with the main body side high voltage contact 24 of the apparatus main body 2. Thus, the high voltage substrate 25 is connected to the sleeve 56 of the magnetic roller 43 via the unit side high voltage contact 64 and the main body side high voltage contact 24.

With reference to FIG. 4, as the development unit 8 is attached to the apparatus main body 2, the connector main body 81 of the unit side connector 74 of the rear side mounting component 46Rr is engaged with the main body side connector 33 of the apparatus main body 2. Thus, the sensor 48 is connected to the controller 34 via the wire 49, the unit side connector 74, and the main body side connector 33, which enables the detection signal of the toner density outputted from the sensor 48 to be inputted to the controller 34.

As the development unit 8 is attached to the apparatus main body 2, the unit side joint 52 of the supporting member 41 is engaged with the main body side joint 29 of the apparatus main body 2. Thus, the unit side joint 52 can be rotated integrally with the main body side joint 29.

In the image forming apparatus 1 with the aforementioned configuration, when the electrostatic latent image formed on the photosensitive drum 7 is developed by the development unit 8, the driving source 30 is driven. When the driving source 30 is driven, the main body side joint 29 rotates by driving force from the driving source 30, which causes the unit side joint 52 engaged with the main body side joint 29 to rotate. Thus, when the unit side joint 52 rotates, the rotation of the unit side joint 52 is transmitted to each agitating screw 42 and the sleeve 56 of the magnetic roller 43, which causes each agitating screw 42 and the sleeve 56 of the magnetic roller 43 to rotate. Further, when the electrostatic latent image formed on the photosensitive drum 7 is developed by the development unit 8, the high voltage substrate 25 applies a development bias to the sleeve 56 of the magnetic roller 43 via the main body side high voltage contact 24 and the unit side high voltage contact 64.

As described above, when each agitating screw 42 rotates, the developer stored in the supporting member 41 is agitated by each agitating screw 42 and electrically charged. The electrically charged developer is drawn up by magnetic force of each magnetic pole 55 of the magnetic roller 43 and carried by the sleeve 56 of the magnetic roller 43. The developer carried by the sleeve 56 is conveyed in accordance with the rotation of the sleeve 56, and after the thickness of a layer of the developer is regulated by the blade 44, the developer is introduced to a facing region between the sleeve 56 and the photosensitive drum 7. According to this, the toner in the developer is adhered to the electrostatic latent image on the photosensitive drum 7 by an electric potential difference between the sleeve 56 of the magnetic roller 43 and the photosensitive drum 7. That is, the toner is supplied from the sleeve 56 of the magnetic roller 43 to the photosensitive drum 7. Consequently, the electrostatic latent image formed on the photosensitive drum 7 is developed.

Incidentally, as described above, in the present embodiment, the magnetic roller 43 is pressed to the photosensitive drum 7, thereby regulating a facing interval between the magnetic roller 43 and the photosensitive drum 7. With the introduction of the aforementioned configuration, when a rotation pivot of the development unit 8 or a pressing mechanism is provided in the apparatus main body 2, a direction or magnitude of force, by which the magnetic roller 43 is pressed to the photosensitive drum 7, greatly depends on a state of attachment of the development unit 8 to the apparatus main body 2. Thus, depending on a state of attachment of the development unit 8 to the apparatus main body 2, the pressing of the magnetic roller 43 against the photosensitive drum 7 may become unstable.

However, as described above, in the present embodiment, the mounting components 46Fr and 46Rr that are positioned to the apparatus main body 2 and rotatably support the supporting member 41, and the coil springs 47Fr and 47Rr that press the magnetic roller 43 to the photosensitive drum 7 by biasing the supporting member 41 in the rotating direction R are provided, not in the apparatus main body 2, but in the development unit 8. Thus, it is possible to prevent a direction or magnitude of force, by which the magnetic roller 43 is pressed to the photosensitive drum 7, from depending on a state of attachment of the development unit 8 to the apparatus main body 2, and it is possible to stably press the magnetic roller 43 against the photosensitive drum 7.

The rear side mounting component 46Rr includes the unit side connector 74 engaged with the main body side connector 33 of the apparatus main body 2. The development unit 8 includes the sensor 48 attached to the supporting member 41 and the wire 49 that connects the sensor 48 to the unit side connector 74. With the introduction of the aforementioned configuration, the sensor 48 can be connected to the controller 34 via respective connectors 33 and 74 without changing a relative positional relation of the unit side connector 74 to the main body side connector 33. Consequently, the necessity for the flexible connection between the main body side connector 33 and the unit side connector 74 is eliminated, which achieves the simplification of the connection structure of the respective connectors 33 and 74.

The front side mounting component 46Fr includes the unit side high voltage contact 64 that comes in contact with the main body side high voltage contact 24 of the apparatus main body 2. With the introduction of the aforementioned configuration, it is possible to connect the sleeve 56 of the magnetic roller 43 with the high voltage substrate 25 via the respective high voltage contacts 24 and 64 without changing a relative positional relation of the unit side high voltage contact 64 to the main body side high voltage contact 24. Consequently, the necessity for the flexible connection between the main body side high voltage contact 24 and the unit side high voltage contact 64 is eliminated, which achieves the simplification of the contact structure of the respective high voltage contacts 24 and 64.

The supporting member 41 includes the unit side joint 52 engaged with the main body side joint 29 of the apparatus main body 2, and the through hole 76 that exposes the unit side joint 52 to the outside of the development unit 8 is provided in the rear side mounting component 46Rr. With the introduction of the aforementioned configuration, it is possible to steadily engage the unit side joint 52 with the main body side joint 29.

The apparatus main body 2 includes the recesses 21, 23, 28 and 32 extended along the attachment direction X, and the mounting components 46Fr and 46Rr include the protrusions 65, 66, 75, and 77 extended along the attachment direction X. As the development unit 8 is attached to the apparatus main body 2, the protrusions 65, 66, 75, and 77 are engaged with the recesses 21, 23, 28 and 32, respectively, and the mounting components 46Fr and 46Rr are positioned to the apparatus main body 2. With the introduction of the aforementioned configuration, the mounting components 46Fr and 46Rr can be steadily positioned to the apparatus main body 2.

Further, the mounting components 46Fr and 46Rr are provided as a pair and rotatably support both end parts in the front-and-rear direction of the supporting member 41. With the introduction of the aforementioned configuration, the mounting components 46Fr and 46Rr stably support the supporting member 41.

In the present embodiment, the coil springs 47Fr and 47Rr arranged between the supporting member 41 and the mounting component 46Fr and between the supporting member 41 and the mounting component 46Rr respectively are used as pressing members. With the introduction of the aforementioned configuration, the configuration of the pressing members can be simplified.

The magnetic roller 43 includes the sleeve 56 facing the sheet passing region of the photosensitive drum 7 with an interval and rollers 57 that are arranged coaxially with the sleeve 56 and come in contact with the non-sheet passing region of the photosensitive drum 7. With the introduction of the aforementioned configuration, the interval between the sheet passing region of the photosensitive drum 7 and the sleeve 56 can be steadily regulated.

In the present embodiment, the two-component developer composed of the toner and the carrier is used as the developer. In contrast, in another different embodiment, one-component developer composed of only the toner may be used as the developer. In the present embodiment, the nonmagnetic toner is used as the toner. In contrast, in another different embodiment, a magnetic toner may be used as the toner.

In the present embodiment, the magnetic roller 43 including the magnetic poles 55 is used as the toner supplying member. In contrast, in another different embodiment, a roller that do not include the magnetic poles may be used as the toner supplying member.

In the present embodiment, the sleeve 56 of the magnetic roller 43 faces the sheet passing region (region through which the sheet passes) of the photosensitive drum 7 with an interval. In contrast, in another different embodiment, the sleeve 56 of the magnetic roller 43 may come in contact with the sheet passing region of the photosensitive drum 7.

In the present embodiment, the coil springs 47Fr and 47Rr are used as the pressing members. In contrast, in another different embodiment, members such as a plate spring and a cam, except for the coil springs 47Fr and 47Rr, may be used as the pressing members.

In the present embodiment, the image forming apparatus 1 is the multifunctional peripheral. On the other hand, in other embodiments, the image forming apparatus 1 may be a printer, a copying machine, or a facsimile, or the like.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. An image forming apparatus comprising:

an image carrier on which an electrostatic latent image is formed;

a development unit to develop the electrostatic latent image formed on the image carrier; and an apparatus main body to which the development unit is attached, wherein the development unit includes:

a toner supplying member to supply a toner to the image carrier;

a supporting member to support the toner supplying member;

at least one mounting component to be engaged with the apparatus main body and rotatably support the supporting member; and at least one pressing member to press the toner supplying member to the image carrier by biasing the supporting member in a rotating direction, wherein at least a part of the toner supplying member rotates around a rotation axis extended along one direction, the at least one mounting component comprises a pair of mounting components to rotatably support both end portions of the supporting member in the one direction respectively, wherein each mounting component includes:

a base plate to extend along an up-and-down direction; and a protruding plate to protrude from a lower end part of the base plate to an inside in the one direction, wherein the at least one pressing member comprises a pair of pressing members, and each pressing member is arranged between a bottom face of the supporting member and an upper face of the protruding plate of each mounting component.

2. The image forming apparatus according to claim 1, wherein each pressing member is a coil spring arranged between the supporting member and each mounting component.

3. The image forming apparatus according to claim 1, wherein the toner supplying member includes:

a sleeve to face the image carrier with an interval; and a roller to be arranged coaxially with the sleeve and come in contact with the image carrier.

4. The image forming apparatus according to claim 3, wherein the toner supplying member further includes:

a roller shaft; and plural magnetic poles to cover an outer circumference of the roller shaft, wherein the sleeve covers an outer circumference of the plural magnetic poles.

* * * * *